US005467423A

United States Patent [19]

Jakubowski

[11] Patent Number: 5,467,423

[45] Date of Patent: Nov. 14, 1995

[54] MIRROR DEFOGGER WITH TELESCOPING HOT AIR OUTLET MOUNTED ADJACENT A MIRROR SIDE DIRECTING HEATED AIRFLOW THEREOVER

[76] Inventor: Henryk P. Jakubowski, 65-10 108th St., Apt. 5H, Forest Hills, N.Y. 11375

[21] Appl. No.: 229,914

[22] Filed: Apr. 19, 1994

[51] Int. Cl.[6] ..... F24H 3/02; H05B 3/00

[52] U.S. Cl. ..... 392/379; 392/382; 219/219; 219/220; 15/250.003

[58] Field of Search ..... 392/379, 382, 392/383, 384, 385; 219/219, 220; 359/512, 509, 838, 845; 15/250.003, 250.05; 34/91, 579, 585, 588

[56] References Cited

U.S. PATENT DOCUMENTS

| | | | |
|---|---|---|---|
| 1,465,292 | 8/1923 | Wessig | 392/379 |
| 2,171,662 | 9/1939 | Marchand | 219/219 |
| 2,617,701 | 11/1952 | Fennell | 219/219 |
| 2,856,700 | 10/1958 | Wales | 34/91 |
| 3,384,977 | 5/1968 | Rosenberg | 219/219 |
| 4,037,079 | 7/1977 | Armbruster . | |
| 4,366,368 | 12/1982 | Stephens, III | 392/385 |
| 4,602,146 | 7/1986 | Barns et al. | 392/384 |
| 4,701,594 | 10/1987 | Powell . | |
| 4,988,847 | 1/1991 | Argos et al. . | |
| 5,063,283 | 11/1991 | Orazi . | |
| 5,251,066 | 10/1993 | Appelbaum | 219/219 |

FOREIGN PATENT DOCUMENTS

| | | | |
|---|---|---|---|
| 876910 | 11/1942 | France | 392/379 |
| 2616635 | 12/1988 | France . | |
| 2640360 | 6/1990 | France . | |
| 2255305 | 5/1974 | Germany | 219/219 |
| 3544030 | 6/1987 | Germany . | |
| 3638004 | 5/1988 | Germany . | |
| 336186 | 10/1930 | United Kingdom | 392/379 |
| 416279 | 9/1934 | United Kingdom | 392/379 |

*Primary Examiner*—John A. Jeffery
*Attorney, Agent, or Firm*—Collard & Roe

[57] ABSTRACT

An electrically powered bathroom fixture for use in conjunction with a mirror having a straight side. An electrical housing is mounted adjacent to the mirror to pivotally support a telescopic housing. The telescopic housing includes a hot air outlet extending parallel to the straight side of the mirror. The hot air outlet is adjustable to approximately the length of the straight side of the mirror. An end cap, mounted adjacent to the mirror, pivotally supports the opposite end of the telescopic housing. Electrical power is provided to the electrical housing for powering a receptacle with ground fault protection and an electrical hot air source. The electrical hot air source forces hot air through the length adjustable hot air outlet against the mirror. The telescopic housing is rotated between the electrical housing and the end cap to adjust the angle of the hot air outlet and the forced hot air with respect to the side of the mirror to selectively defog the mirror.

7 Claims, 3 Drawing Sheets

MIRROR DEFOGGER WITH TELESCOPING HOT AIR OUTLET MOUNTED ADJACENT A MIRROR SIDE DIRECTING HEATED AIRFLOW THEREOVER

BACKGROUND OF THE INVENTION

1. Field of the Invention

The present invention relates to a mirror defogger that is adjustable to the size of the mirror and includes at least one ground fault protected receptacle.

2. The Prior Art

Frequently, the use of a bathroom mirror is required following showering. However, such mirrors most always become fog covered and simply wiping the mirror does not prevent water from continuing to condense on the mirror, thereby inhibiting, if not completely preventing, use of the mirror.

Accordingly, the prior art includes several anti-fogging designs that are intended to eliminate the formation of condensation on a bathroom mirror. These design proposals generally include a fan unit that is attached to the mirror to blow hot air across the mirror. The fan unit can be a hand-held hair dryer type device. U.S. Pat. No. 4,037,079 to Armbruster and U.S. Pat. No. 4,988,847 to Argos et al are two examples of bathroom mirror defoggers.

Certain drawbacks exist to these devices in that they cannot be adjusted to variously sized mirrors and they do not provide other features which are typically required in modern bathrooms. An attempt to overcome certain of these deficiencies has resulted in mirror defogging units as set forth in U.S. Pat. No. 4,701,594 to Powell and U.S. Pat. No. 5,063,283 to Orazi. These devices include the mirror so that the defogger is assured of being properly aligned with the mirror surface. In addition, these devices provide some additional features which are typically found in modern bathrooms. However, these devices are fairly complex and expensive and require that the existing mirror or cabinet fixture be removed and replaced with the patented items. Furthermore, these devices do not provide the latest safety features, which are extremely important in applications where water is likely to be present.

Therefore, there is a need for a bathroom mirror defogger that can be retro-fitted to existing mirrors and which provides personal heating, lighting, vent and ground fault protection.

SUMMARY OF THE INVENTION

It is therefore an object of the present invention to provide a mirror defogger which overcomes the drawbacks of the prior art and can be quickly and easily adjusted to accommodate different size mirrors.

It is a further object of the present invention to provide a mirror defogger with personal heating, lighting and vent features.

It is yet another object of the present invention to provide a mirror defogger in which all the electrical components have ground fault protection.

These and other related objects are achieved according to the invention by a mirror defogger or an electrically powered bathroom fixture for use in conjunction with a mirror. The fixture includes a telescopic housing having a hot air vent for mounting adjacent a side of a mirror. The hot air vent is adjustable to approximately the length of the side of the mirror. A wire and a plug provide power to the telescopic housing from an electrical source. A receptacle having ground fault protection is coupled to a wire. The receptacle may be piggy-backed to the plug, like Christmas tree light strings, or may be mounted within the housing. In a modification, one receptacle is piggy-backed to the plug, so that the mirror defogger does not solely occupy the bathroom's existing plug or one of the bathroom's plugs. An additional one or two receptacles are also mounted in the housing.

The receptacles also have a feed-through configuration for providing ground fault protection for electrical components wired downstream of the receptacle. As a result, even if the bathroom's existing receptacle does not have ground fault protection, use of the bathroom defogger of the invention provides ground fault protection, not only for the bathroom defogger itself, but for any additional components which are plugged into the defogger's receptacles.

An electrical hot air source is disposed within the telescopic housing and is wired downstream of the receptacle. The electrical hot air source forces hot air through the length of the adjustable air vent against the mirror to defog it. The hot air source includes a heater coil, a fan for blowing air over the heater coil and through the air vent and a fan speed switch connected between the receptacle and the first fan for switching the first fan off and on and selecting at least one first fan speed.

The fixture also includes a lamp mounted on the telescopic housing and a lamp switch connected between the receptacle and the lamp, switching the light off and on.

The mirror defogger also includes a vent hose connected to the electrical housing. If a single fan is used, it will be a reversible fan for blowing air over the heater coil and through the air vent in a first direction of operational rotation and blowing air through the vent hose in a second direction of operational rotation. In an alternate embodiment, a second fan is provided for blowing air through the vent hose, separate from the fan associated with the heater coil. A second fan speed switch is connected between the receptacle and the second fan, for switching the second fan off and on and selecting at least one second fan speed.

The electrical housing includes an electrical box containing the switches, the lamps and fans. The telescopic tube is pivotally mounted on the electrical housing containing the heater coil. The hot air vent extends longitudinally along at least part of the tube, with the tube pivoting to rotate the hot air vent with respect to the mirror. The telescopic tube further includes an adjustable vent located approximately 90° from the hot air vent. The adjustable vent is adjustable between an open and a closed position, and is adjustable to direct a stream of hot air generally away from the mirror to warm a selected individual position in front of the mirror.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
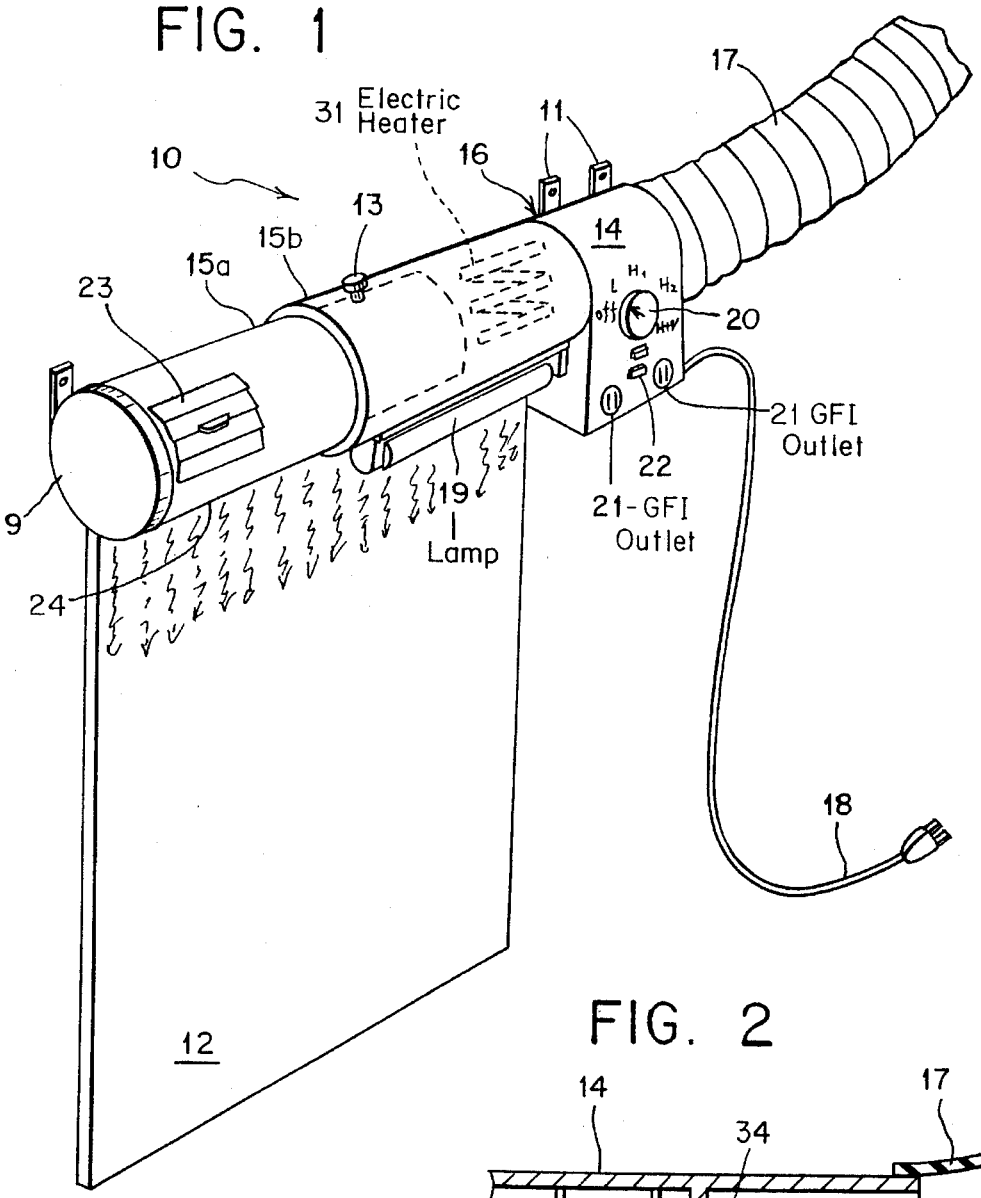
FIG. 1 is a perspective view of an embodiment of the mirror defogger mounted adjacent the top of a mirror.

Referring now in detail to the drawings and, in particular, FIG. 1, there is shown a bathroom fixture or mirror defogger 10, mounted with mounting brackets 11, adjacent a mirror 12. Alternatively, several mounting brackets may be glued to the mirror with mating recesses on the rear of fixture 10, sliding downwardly over the brackets to secure the fixture by the brackets. An electrical housing 14 is stationarily mounted adjacent mirror 12 and pivotally supports a telescopic housing or tube 15*a* and 15*b*. A pivoting joint 16 between electrical housing 14 and tube 15*a*, allows tube 15*a* to be rotated with respect to housing 14. A vent hose 17 extends from the opposite side of electrical housing 14 from the tube 15*a*. An end cap 9 may be secured to the wall or mirror to stabilize the opposite end of tube 15*b* which would be freely rotatable within end cap 9.

A plug 18 provides power to electrical housing 14 from an electrical power source. A lamp 19 is mounted on a lower part of tube 15. A multi-function switch 20 provides control for the various features of the bathroom fixture 10. One or more ground fault interrupter (GFI) outlets 21 are provided on electrical housing 14. GFI outlets 21 are equipped with test/reset switches 22. An adjustable individual vent 23 is provided on part of tube 15.

Figure 2:
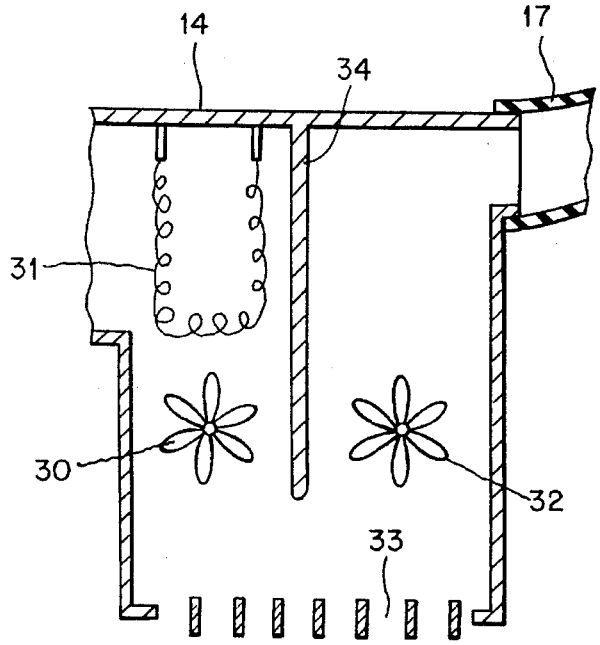
FIG. 2 is a cross-sectional view of the housing, showing a two fan design.

Referring now to FIG. 2, there is shown a first embodiment of the components within electrical housing 14. A heater fan 30 is provided for moving air across coil 31 and through tube 15. A vent fan 32 moves air through vent hose 17. A common intake 33 allows air to flow to both fans 30 and 32. A partition 34 separates the fans 30 and 32 from each other and directs the respective air flow from each fan.

Figure 3:
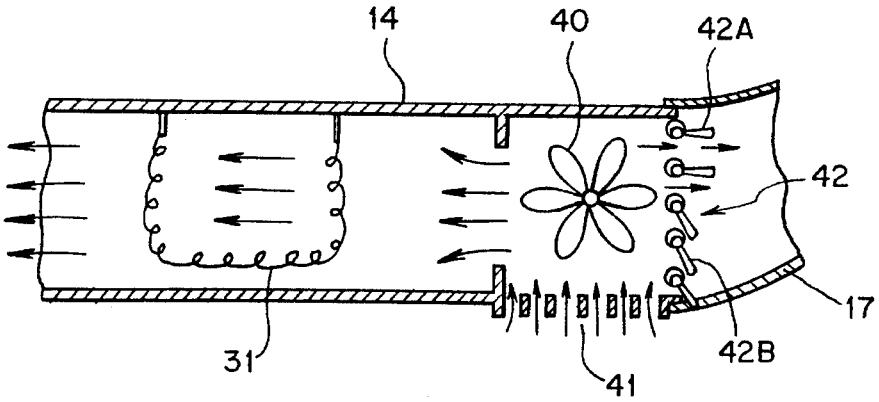
FIG. 3 is a cross-sectional view of the housing, showing a reversible fan design.

Referring now to FIG. 3, there is shown a second embodiment of the component with electrical housing 14. A reversible fan 40 is shown for drawing air in through intake 41 and moving it either across heater coil 31 or through vent hose 17. A baffle 42 controls the air flow through vent hose 17. Baffle 42 is formed by a series of pivotally mounted plates that are forced by a spring into a closed position, designated as 42*b*. When fan 40 is directing air toward heater coil 31, the baffle remains closed. When reversible fan 40 is moving air toward vent tube 17, the flow of air pushes the plates open, as designated by reference numeral 42*a*, against the biasing force of the spring. The purpose of the baffle is to prevent outside air from blowing through vent hose 17 when said vent hose is directed outside.

Figure 4:
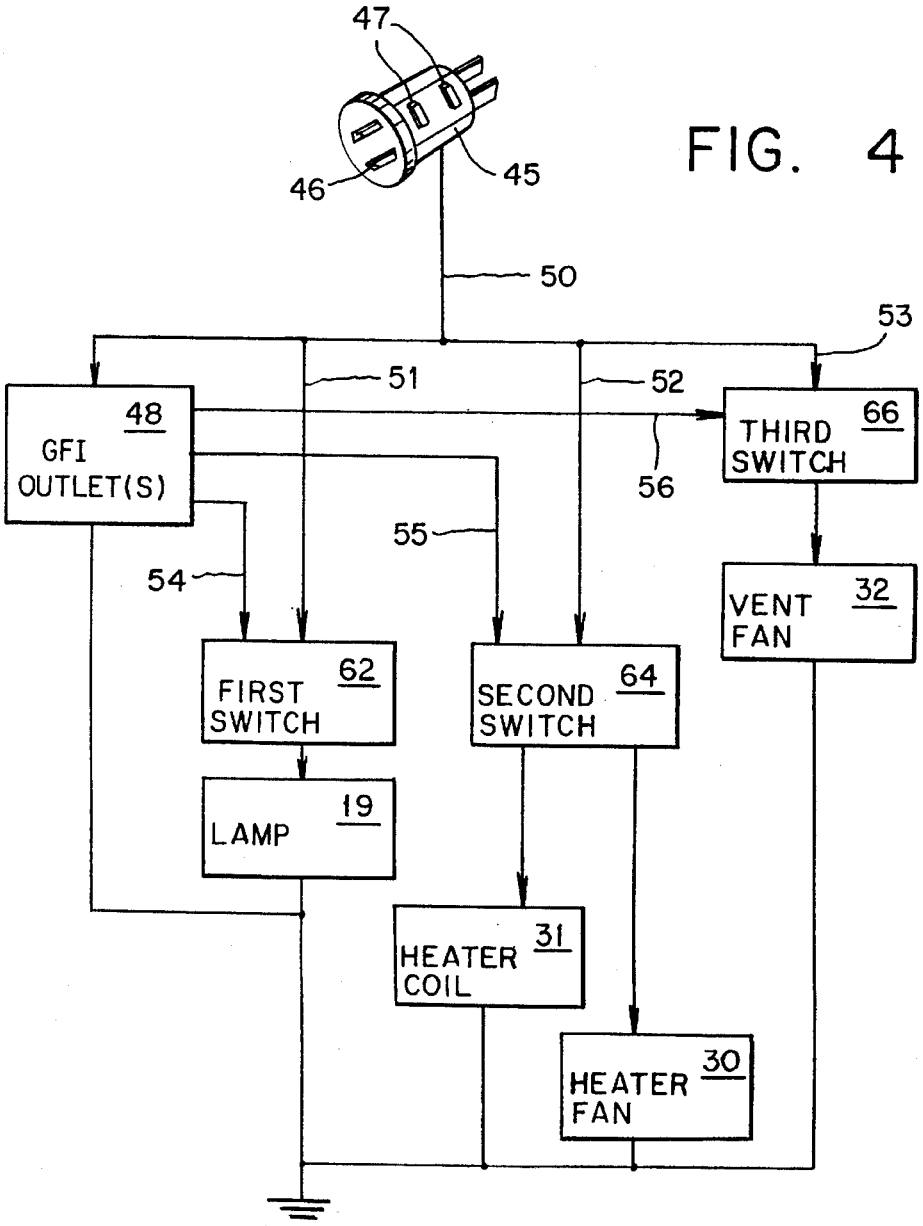
FIG. 4 is a block circuit diagram of the various components of the mirror defogger.

Referring now to FIG. 4, there is shown an embodiment of plug 18 in the form of a piggy-back plug 45. Plug 45 includes an outlet 46, similar to those found on Christmas tree light sets. Test/reset buttons 47 are located on plug 45 and receptacle 46 is a GFI protected outlet. Alternatively, a regular plug may be provided with one or more GFI outlets 48 located on electrical housing 14. Older bathrooms typically do not have enough outlets to accommodate the modern consumer use of electrical razors, hair dryers, curling irons, etc. In addition, older bathrooms, which are provided with outlets, typically do not have GFI protected outlets. The combination of receptacles on plug 45 and on electrical housing 14 are intended to provide additional GFI protected outlets. Instead of the multi-function switch 20, as shown in FIG. 1, there are three separate switches shown in FIG. 4. The first switch 62 is for lamp 19, the second switch 64 is for heater coil 31 and fan 30, and the third switch 66 is for vent fan 32. In the event that a single reversible fan is used, then the second switch 64 would be a double-throw switch to power heater coil 31 and heater fan 30 in a first position and power vent fan 32 in a second position. Depending on the configuration of the GFI outlets, switch 62 would be powered either through lines 51 or 54. Similarly, switches 64 and 66 would be powered through lines 52 and 55, or 53 and 56, respectively.

Figure 5:
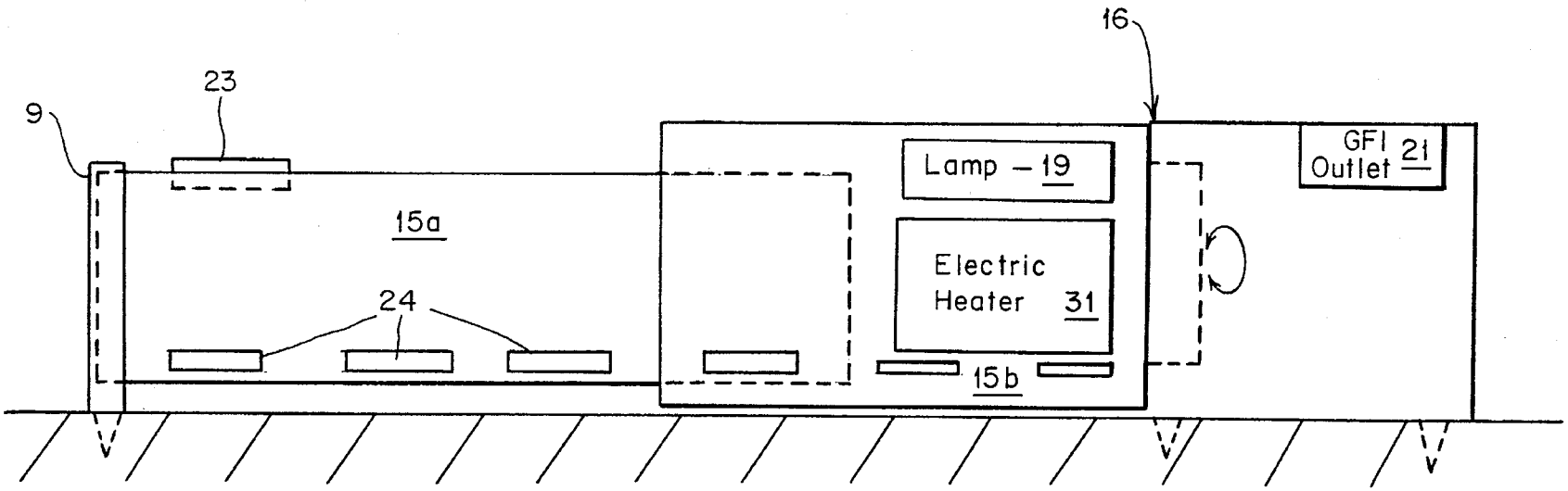
FIG. 5 is a bottom view of the telescoping housing showing the configuration of the hot air outlet which achieves the air flow depicted in FIG. 1.

Referring again to FIGS. 1 and 5, mirror defogger 10 is conveniently mounted along one side of mirror 12 via mounting brackets 11. A lock screw 13 is loosened and telescopic tube 15 is adjusted to approximately the length of the side of the mirror adjacent where mirror defogger 10 has been mounted. A hot air outlet 24 is disposed along the bottom surface of tube 15. Tube 15 is adjusted so that hot air outlet 24 does not exceed the length of the side of the mirror that it faces. Vent hose 17 is then routed out of the bathroom, and preferably is vented outdoors. Multi-function switch 20 is then manually operated to select operation of the lamp, one or more heater settings, and a vent setting. The individual vent 23 operates in a manner similar to the heating and cooling vent in an automobile dashboard. Individual vent 23 can be closed or opened and directed to blow warm air at an individual standing in front of the mirror. The flow of warm air through individual vent 23 can be used to dry hands, dry hair, or simply warm the individual following showering, etc. Although, a multi-function switch is shown, each component may be operated by an individual switch. All of the electrical components are wired downstream of the GFI outlets. Additional information on an electrical receptacle equipped with ground fault protection can be found in U.S. Pat. No. 4,010,432 to Klein et al, the subject matter of which is incorporated herein by reference thereto.

While several embodiments of the present invention have been shown and described, it is to be understood that many changes and modifications may be made thereunto without departing from the spirit and scope of the invention as defined in the appended claims.

What is claimed is:

1. An electrically powered bathroom fixture in combination with a mirror having a rectilinear side, the fixture comprising:

(a) an electrical housing mounted adjacent to the mirror;

(b) a telescopic housing having a first end, a spaced opposite second end, and a hot air outlet, said first end being pivotally mounted to said electrical housing, said hot air outlet extending parallel to the rectilinear side of the mirror and being adjustable to approximately the length of the rectilinear side of the mirror;

(c) an end cap mounted adjacent to the mirror for pivotally supporting said second end of said telescopic housing (d) electrically conductive means connected to said electrical housing for providing power to said electrical housing from an electrical power source;

(e) a receptacle having ground fault protection connected to said electrically conductive means, said receptacle having a feed-through configuration for providing ground fault protection for electrical components wired downstream of said receptacle;

(f) an electrical hot air source disposed within said telescopic housing and being wired downstream of said receptacle; and (g) wherein said electrical hot air source forces hot air through said length-adjustable hot air outlet against the mirror, said telescopic housing being rotated between said electrical housing and said end cap to adjust the angle of said hot air outlet and the forced hot air with respect to the rectilinear side to selectively defog the mirror.

2. The fixture according to claim 1, wherein said hot air source comprises:

(a) a heater coil;

(b) a first fan for blowing air over said heater coil and through the hot air outlet; and (c) a first fan speed switch connected downstream of said receptacle and connected to said first fan for switching said first fan off and on and selecting at least one first fan speed.

3. The fixture according to claim 2, further comprising:

(a) a lamp mounted on said telescopic housing; and (b) a lamp switch connected downstream of said receptacle and connected to said lamp for selectively switching said lamp off and on.

4. The fixture according to claim 3, additionally including a vent hose coupled to said electrical housing and wherein said first fan is a reversible fan for blowing air over said heater coil and through the air vent in a first direction of rotation and blowing air through said vent hose in a second direction of rotation.

5. The fixture according to claim 3, additionally including:

(a) a vent hose connected to said housing;

(b) a second fan for blowing air through said vent hose; and (c) a second fan speed switch connected downstream of said receptacle and connected said second fan for switching said second fan off and on and selecting at least one second fan speed.

6. The fixture according to claim 5, wherein said electrical housing includes:

(a) an electrical box containing said switches and said fans; and (b) said telescopic housing being pivotally mounted on said electrical box containing said heater coil, said hot air outlet extending longitudinally along at least part of said telescopic housing with said telescopic tube being pivotable to rotate said hot air vent with respect to the mirror.

7. The fixture according to claim 6, wherein said telescopic housing further includes an adjustable vent located approximately 90° from said hot air vent, said adjustable vent being adjustable between an open and closed position and adjustable to direct a stream of hot air generally away from the mirror to warm an individual positioned in front of the mirror.

* * * * *